United States Patent [19]

Thompson et al.

[11] 4,322,058

[45] Mar. 30, 1982

[54] PIPE SIDE VALVE

[75] Inventors: Robert E. Thompson, Houston; Richard P. McNinney, Richmond, both of Tex.

[73] Assignee: Schmidt Manufacturing, Inc., Houston, Tex.

[21] Appl. No.: 176,058

[22] Filed: Aug. 7, 1980

[51] Int. Cl.[3] ..... F16K 31/50

[52] U.S. Cl. ..... 251/145; 251/218

[58] Field of Search ..... 137/322; 251/145, 146, 251/218, 223

[56] References Cited

U.S. PATENT DOCUMENTS

| | | | |
|---|---|---|---|
| 581,342 | 4/1897 | Engel | 251/146 |
| 3,443,789 | 5/1969 | Glasgow et al. | 251/223 X |
| 3,572,630 | 3/1971 | Mendenhall | 251/145 |
| 4,166,050 | 3/1979 | Graves | 251/145 X |

*Primary Examiner*—William R. Cline

*Attorney, Agent, or Firm*—Carl B. Fox, Jr.

[57] ABSTRACT

Valve apparatus for controlling flow of particulate material, such as sand or other abrasive material, from a tank or hopper. The valve has a unitary plunger which is movable axially with respect to a lateral particulate material inlet between positions closing and opening the inlet, the plunger being moved by rotation of a threaded portion of the plunger through an internally threaded cap or bonnet opening. The valve body passage through which the plunger is disposed, and the plunger itself, are formed to have abrasion-resistant surfaces. A lateral air pipe nipple sealed to the valve body receives the abrasive material flowing through the valve for use in sand blasting operations.

24 Claims, 2 Drawing Figures

PIPE SIDE VALVE

BACKGROUND OF THE INVENTION

The valve apparatus afforded by this invention is for controlling flow of subdivided abrasive material, such as sand, from a vessel containing such material. Because of the abrasive nature of the material which passes through the valves, valves of this type are subjected to serious abrasive wear conditions. The parts of such a valve subjected to such abrasive wear must be made of abrasive resistant material, or must be surface-finished in a manner to minimize abrasive wear, or must be replaceable. Otherwise, the useful life of such valves will be limited. This invention seeks to provide improved valve apparatus for use with subdivided abrasive materials which will have a long useful life and which will not be subject to failure in use.

SUMMARY OF THE INVENTION

The invention provides valve apparatus for use in controlling flow of particulate material, especially particulate material which is abrasive in nature. A valve plunger is disposed within a passage through a valve body, for movement between positions opening and closing a particulate material flowway. The valve is made in such a manner that the likelihood that the plunger might be impelled from the valve body by internal pressures within the valve is minimized. At all areas where abrasive wear is likely to occur, materials to resist such abrasive wear are employed. Most parts subject to extreme wear are readily replaceable. The apparatus is designed for trouble-free operation over a long period of useful life. The apparatus is designed to be of simple structure and may be rapidly assembled and disassembled, whenever necessary. The number of parts is reduced as compared with other valves made for similar use. The apparatus is designed for use under dusty conditions without detriment to the valve structure or difficulty in operation resulting therefrom.

A principal object of the invention is to provide valves for use in controlling flow of particulate materials which are not subject to failure in use and which are resistant to abrasion. Another object of the invention is to provide such valves which are simple in structure and which may be readily assembled and disassembled. A further object of the invention is to provide such valves which are safe. Another object of the invention is to provide such valves which are trouble-free and which are economical and which are easily operated.

Other objects and advantages of the invention will appear from the following detailed description of preferred embodiments thereof, reference being made to the accompanying drawings.

BRIEF DESCRIPTIONS OF THE DRAWINGS

DESCRIPTION OF THE PREFERRED EMBODIMENTS

Figure 1:
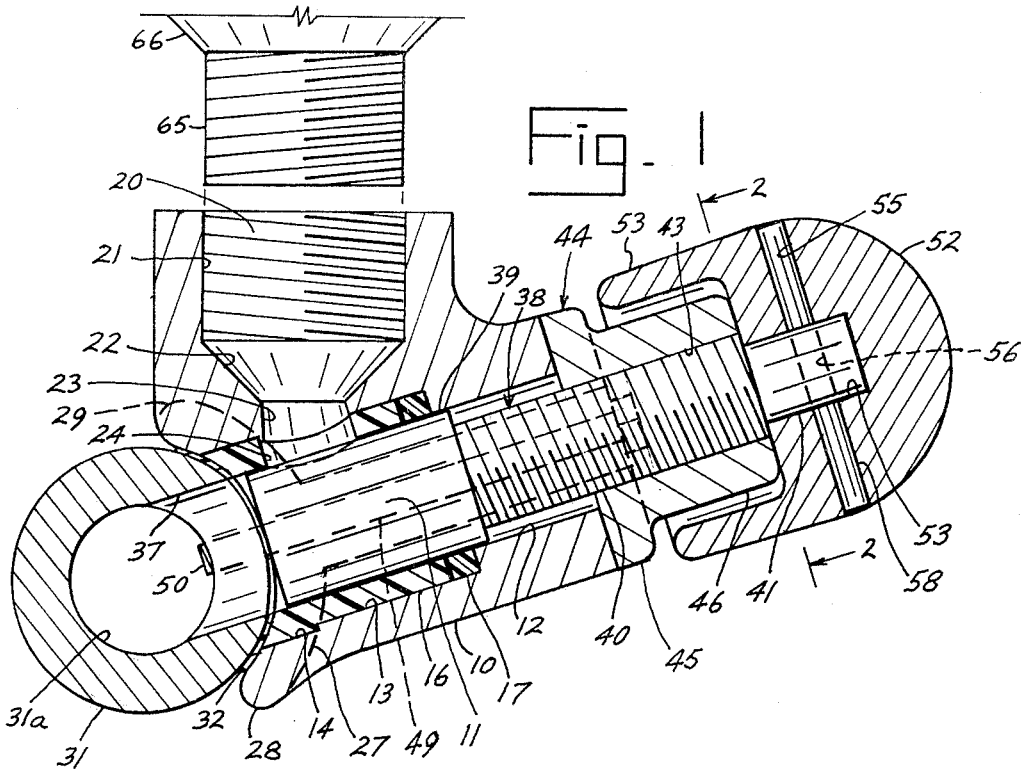
FIG. 1 is a vertical axial cross section showing a preferred embodiment of apparatus according to the invention.
Figure 2:
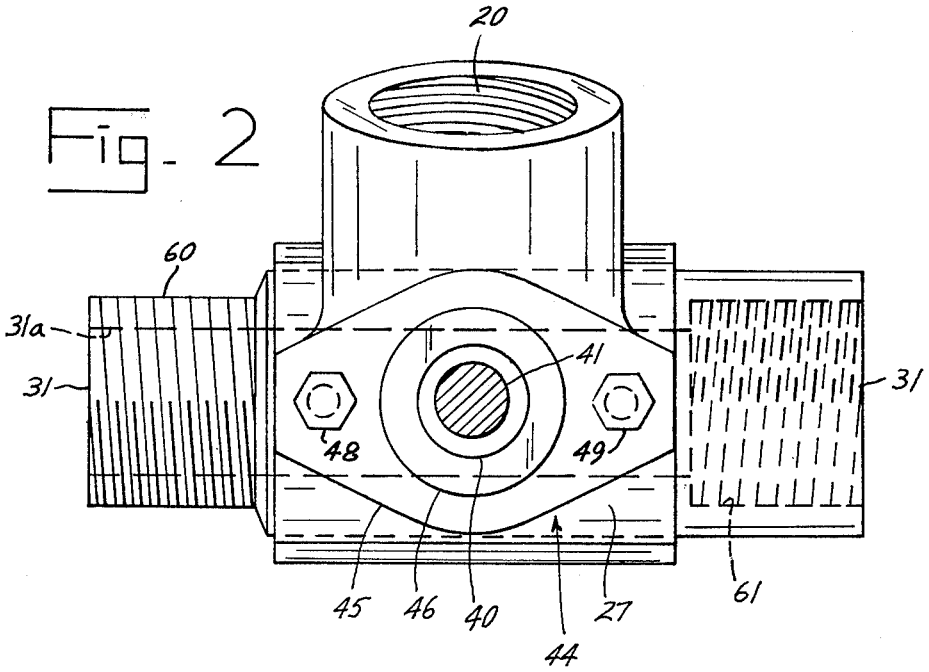
FIG. 2 is an angular cross section showing a portion of the valve shown in FIG. 1, taken at line 2—2 of FIG. 1.

Referring now to the drawings in detail, the preferred embodiment of apparatus according to the invention includes a valve body 10, which may be made as a casting, valve body 10 having a passage 11 therethrough consisting of portions 12, 13, and 14 of differing diameters. Passage portion 13 is of larger diameter than passage portion 12, and passage portion 14 is of larger diameter than portion 13. A tubular sleeve 16 is disposed within passage portion 13, one end thereof being slightly enlarged and being disposed within passage portion 14. A seal ring 17 is disposed between an end of sleeve 16 and the shoulder formed between passage portions 12 and 13. The interior diameters of sleeve 16 and seal ring 17 are either equal to or slightly smaller than the diameter of passage portion 12.

A lateral angular flow passage 20 has an outer portion 21 having interior threads, passage 20 being reduced at frustoconical portion 22, and having inner reduced portion 23. Sleeve 16 has an opening 24 therethrough of approximately the same size as passage portion 23. The exterior shape of body 10 is such as to accommodate passage 20, as shown.

Valve body 10 has a curved plate formation 27 at its lefthand end, FIG. 1, which surrounds the end of passage 11. Formation 27 has the form of an arcuately bent rectangular plate, the edges 28, 29 of which are rounded, as shown. A pipe nipple 31 having the same curvature at its outer periphery as the lefthand side of formation 27 is disposed against formation 27, a gasket 32 being disposed therebetween. Nipple 31 has a passage 37 of circular cross section through its wall, passage 37 being of the same diameter as in the interior diameter of sleeve 16. Gasket 32 is a flat circular washer, being bent around nipple 31 around passage 37 to assume the form shown in the drawings.

A valve plunger 38 has a cylindrical portion 39, a reduced threaded portion 40, and a further reduced cylindrical portion 41, portions 39, 40 and 41 being coaxial. Plunger portion 39 is slidably fitted within sleeve 16 and a seal ring 17. Threaded plunger portion 40 is screwed through a threaded passage 43 through an adapter cap 44. Cap44 has a shaped plate or flange portion 45, and has a socket portion 46 concentrically about threaded passage 43. Body 10 has a cross sectional shape, transverse to passage 11, of the same shape as cap 44. A pair of aligned bolt openings are provided through the flange-like portion 45 of cap 44 and through body 10, one at each side of portion 46. Screws 48, 49 are disposed through these openings and have their ends screwed into tapped openings through the wall of nipple 31 at opposite sides of opening 37. The screw ends protrude slightly into passage 31*a* as shown at 50.

A hemispherically shaped knob 52 has cylindrical skirt 53 which spacedly surrounds cylindrical portion 46 of cap 44. Knob 52 has cylindrical recess 53 into which cylindrical portion 41 of plunger 38 is received. Cross passage 55 of knob 51 and cross passage 56 of cylindrical plunger portion 41 are aligned, and a pin 58 is inserted tightly through the aligned passages to removably affix knob 52 to cylindrical plunger portion 41. Pin 58 must be tightly fitted through the passages in order that it will not inadvertently fall therefrom. Pin 58 may be a shear pin, if desiredd, the pin not being intended to be sheared in this application.

Nipple 31 is shown to have external threads 60 at one end and internal threads 61 at its opposite end. A pressured air supply conduit will normally be connected to nipple 31 at the threads 61, and a sandblasting hose connection fitting or other conduit will normally be fixed to nipple 31 at threads 60.

For use, the valve is connected at threads 20 to a threaded nipple outlet 65 of a sand tank or other container 66. Sand or other particulate abrasive drains from the tank or container 66 through passage 20. When plunger portion 39 covers the entirety of opening 24, sand is prevented from passing into passage 31*a* for nipple 31. When knob 52 is rotated to move plunger 38 toward the right, FIG. 1, plunger portion 39 is partly or fully withdrawn from opening 24, so that sand may enter passage 31*a* at a controlled rate of flow. The rate of flow of the abrasive through the valve may be adjusted from a small rate of flow to a full rate of flow when passage 24 is fully opened. Turning of knob 52 in the opposite direction will, of course, move plunger portion 39 toward the left to close passage 24. Plunger 38 rotates as it is moved axially of the valve passage in either direction. Plunge portion 39 does not make a gas or air tight seal at opening 24, this not being necessary since the interior of tank or container 66 will be at the same air pressure as in the passage 31*a*. Abrasive flow control is very good with the valve design herein presented.

An advantage of the valve apparatus herein disclosed is that the plunger portions 39, 40, and 41 are a single unitary part. This structure simplifies assembly of the apparatus and improves its safety in use, since there is no intermediate connection of parts which could lead to failure of the valve. Plunger 38 may not be blown from the valve by internal pressure within container 66 and passage 31*a* without prior removal of screws 48, 49 and cap 44.

Sleeve 16 may be made of a plastic material such as polyurethane, as indicated in the drawings, or may be of metal. Plunger 38 may also be made of a plastic material such as polyurethane. Type 17-4 precipitation hardened stainless steel has also been found to be satisfactory material for the plunger and for sleeve 16. Sleeve 16 may be made of or faced with Type 17-4 precipitation hardened stainless steel. The cylindrical portion 39 of the plunger may be faced with Type 17-4 precipitation hardened stainless steel, or the entire plunger may be formed of Type 17-4 stainless steel. Seal ring 17 prevents leaking of sand or other abrasive to the area of threaded plunger portion 40, and prevents air or other gas leakage from within container 66 and nipple passage 31*a*.

The apparatus which has been described is very satisfactory in operation. Blockage of the valve against opening or closing does not occur. Close adjustment of the sand or other abrasive flow may be readily obtained without difficulty or delay. The skirt 53 prevents dust and abrasive from entering to about threaded plunger portion 40.

While a preferred embodiment of apparatus according to the invention has been described and shown in the drawings, many modifications thereof may be by a person skilled in the art without departing from the spirit of the invention and it is intended to protect by Letters Patent all forms of the invention falling within the scope of the following claims.

We claim:

1. Valve apparatus, comprising a valve body having a longitudinal valve passage therethrough and having a lateral flow passage communicating with said valve passage at a uniform cylindrical portion of said valve passage adjacent one end of said valve passage, said valve body having a curved formation at said one end of said valve passage through which said uniform cylindrical portion of said valve passage centrally extends, cap means having a threaded passage therethrough disposed to close the other end of said valve passage, a unitary valve plunger having an exteriorly threaded portion screwed through said threaded passage and having a cylindrical portion closely yet slidable disposed in said cylindrical portion of said valve passage, said cylindrical portion of said plunger being slidably movable longitudinally of said cylindrical portion of said valve passage between positions closing and opening said lateral flow passage by rotation of said valve plunger, a pipe nipple having an outward curvature matching said curved formation sealedly engaged at one side thereof against said curved formation and having a wall opening of the same diameter as said uniform cylindrical portion of said valve passage forming a continuation of said valve passage into the interior of said pipe nipple, said pipe nipple having a connection means at each end thereof for connection of conduit means to each end thereof, said lateral flow passage having connection means for connection thereof to conduit means.

2. The combination of claim 1, said cap means and said body means and said pipe nipple being fixed together by screw means extending through screw passage means through said cap means and said body means and screwed into tapped opening means through said pipe nipple wall.

3. The combination of claim 2, including a turning knob fixed to the end of said valve plunger extending through said cap means by pin means removably press fitted through aligned transverse openings through said valve plunger and cap means.

4. The combination of claim 1, including a turning knob fixed to the end of said valve plunger extending through said cap means by pin means removably press fitted through aligned transverse openings through said valve plunger and cap means.

5. The combination of claim 1, said cylindrical portion of said valve passage having removable sleeve means therearound having port means therethrough in register with said lateral flow passage.

6. The combination of claim 5, said sleeve means being formed of polyurethane.

7. The combination of claim 5, said sleeve means having an abrasion resistant interior surface.

8. The combination of claim 7, said cylindrical portion of said valve plunger having an abrasion resistant outer surface.

9. The combination of claim 7, said valve plunger being formed of an abrasion resistant stainless steel.

10. The combination of claim 5, said sleeve means being formed of an abrasion resistant stainless steel.

11. The combination of claim 10, said valve plunger being formed of polyurethane.

12. The combination of claim 10, said valve plunger having an abrasion resistant outer surface.

13. The combination of claim 12, said abrasion resistant outer surface of said valve plunger being formed by a polyurthane coating.

14. The combination of claim 12, said abrasion resistant outer surface of said valve plunger being formed by a coating of abrasion resistant stainless steel.

15. The combination of claim 5, said valve passage having stepped diameters and circular seal ring means being provided between the inner end of said sleeve means and a shoulder formed between adjacent stepped diameters, said seal ring means engaging said cylindrical portion of said valve plunger to prevent leakage of gas pressure from within said valve body to said threaded valve plunger portion.

16. The combination of claim 15, said sleeve means being formed of polyurethane.

17. The combination of claim 15, said sleeve means having an abrasion resistant interior surface.

18. The combination of claim 17, said cylindrical portion of said valve plunger having an abrasion resistant outer surface.

19. The combination of claim 17, said valve plunger being formed of an abrasion resistant stainless steel.

20. The combination of claim 15, said sleeve means being formed of an abrasion resistant stainless steel.

21. The combination of claim 20, said valve plunger being formed of polyurethane.

22. The combination of claim 20, said valve plunger having an abrasion resistant outer surface.

23. The combination of claim 22, said abrasion resistant outer surface of said valve plunger being formed by a polyurethane coating.

24. The combination of claim 22, said abrasion resistant outer surface of said valve plunger being formed by a coating of abrasion resistant stainless steel.

* * * * *